US005971731A

United States Patent [19]

Marin

[11] Patent Number: 5,971,731

[45] Date of Patent: Oct. 26, 1999

[54] NOSE CONE FOR SMALL SPIN HEAD IN FLASH SPINNING SYSTEM

[75] Inventor: Robert Anthony Marin, Midlothian, Va.

[73] Assignee: E. I. du Pont de Nemours and Company, Wilmington, Del.

[21] Appl. No.: 08/960,611

[22] Filed: Oct. 29, 1997

Related U.S. Application Data

[60] Provisional application No. 60/029,540, Nov. 1, 1996.

[51] Int. Cl.[6] ..... D01D 4/02

[52] U.S. Cl. ..... 425/72.2; 425/191; 425/192 S; 425/382.2; 425/461

[58] Field of Search ..... 425/72.2, 191, 425/192 S, 382.2, 464, 461; 264/103, 211.14

[56] References Cited

U.S. PATENT DOCUMENTS

| | | | |
|---|---|---|---|
| 3,081,519 | 3/1963 | Blades et al. . | |
| 3,169,899 | 2/1965 | Steuber . | |
| 3,227,794 | 1/1966 | Anderson et al. . | |
| 3,417,431 | 12/1968 | Majoch | 425/191 |
| 3,484,899 | 12/1969 | Smith . | |
| 3,497,918 | 3/1970 | Pollock et al. . | |
| 3,543,332 | 12/1970 | Wagner et al. | 425/72.2 |
| 3,801,519 | 4/1974 | Brodof . | |
| 3,851,824 | 12/1974 | Svensson | 239/132.3 |
| 3,860,369 | 1/1975 | Brethauer et al. . | |
| 4,084,930 | 4/1978 | Neveu et al. | 425/198 |
| 4,352,650 | 10/1982 | Marshall . | |
| 4,554,207 | 11/1985 | Lee . | |
| 4,642,262 | 2/1987 | Piotrowski et al. | 428/296 |
| 5,123,983 | 6/1992 | Marshall . | |
| 5,833,900 | 11/1998 | Franke et al. | 425/382.2 |

*Primary Examiner*—Harold Pyon
*Assistant Examiner*—Joseph Leyson

[57] ABSTRACT

The present invention relates to a novel arrangement for attaching, by screw threads, one device to another wherein the one device has a greater thermal rate of expansion than the other and the devices are assembled at a temperature which is lower than that at which the two devices are regularly subjected. In particular, the novel arrangement maintains the security of the attachment where the differing thermal rates of expansion would normally cause the screw thread attachment to become loose.

7 Claims, 4 Drawing Sheets

NOSE CONE FOR SMALL SPIN HEAD IN FLASH SPINNING SYSTEM

This application claims benefit of priority from Provisional Application No. 60/029,540, filed Nov. 1, 1996.

FIELD OF THE INVENTION

This invention relates to equipment used for flash spinning plexifilaments in a flash spinning system and particularly to the spin head on the spinpack in a flash spinning system.

BACKGROUND AND SUMMARY OF THE INVENTION

E.I. du Pont de Nemours and Company (DuPont) has been making plexifilaments or plexifilamentary film-fibril webs in a flash spinning process for a number of years. DuPont has obtained numerous patents describing the process and equipment including U.S. Pat. No. 3,081,519 to Blades et al., U.S. Pat. No. 3,169,899 to Steuber, U.S. Pat. No. 3,227,794 to Anderson et al., U.S. Pat. No. 3,484,899 to Smith, U.S. Pat. No. 3,497,918 to Pollock et al., U.S. Pat. No. 3,860,369 to Brethauer et al., U.S. Pat. No. 4,352,650 to Marshall, U.S. Pat. No. 4,554,207 to Lee, and U.S. Pat. No. 5,123,983 to Marshall.

The term "plexifilamentary" as used herein, means a three-dimensional integral network of a multitude of thin, ribbon-like, film-fibril elements of random length and with a mean film thickness of less than about 4 microns and a median fibril width of less than about 25 microns. In plexifilamentary structures, the film-fibril elements are generally coextensively aligned with the longitudinal axis of the structure and they intermittently unite and separate at irregular intervals in various places throughout the length, width and thickness of the structure to form a continuous three-dimensional network.

Referring now to FIG. 1 of the drawings, a spin cell 10 is shown with a large chamber 11 in which a fiber web W is flash spun and formed into a sheet S. The illustration of the spin cell 10 is quite schematic and fragmentary for purposes of explanation. A schematically illustrated spinpack, generally indicated by the number 12, is positioned within the chamber 11 of the spin cell 10 and is in the process of spinning the fiber web W. It should be understood that the process of manufacturing plexifilamentary sheet material includes the use of a multiple spinpacks similar to spinpack 12 which are arranged in the spin cell 10 for spinning and laying down other webs W with edges that overlap each other to form a wide sheet.

The spinpack 12 spins the web from a polymer solution which is provided to the spinpack 12 through a conduit 20. The polymer solution is provided at high temperature and pressure so as to be a single phase solution. The polymer solution is then admitted through a letdown orifice 22 into a letdown chamber 24. There is a pressure drop through the letdown orifice 22 so that the solution experiences a slightly lower pressure in the letdown chamber. At this lower pressure, the single phase solution becomes a two phase solution. A first phase of the two phase solution has a relatively higher concentration of polymer as compared to the polymer concentration of the second phase which has a relatively lower concentration of polymer. The system operates such that concentration of polymer in the solution in conduit 20 may be anywhere from slightly less than ten percent to in excess of twenty five percent based on weight and depending on the spin agent used. Thus, the polymer rich phase may still have more spin agent than polymer on a comparative weight basis. Based on observations, the polymer rich phase appears to be the continuous phase.

From the letdown chamber 24, the two phase polymer solution exits through a spin orifice 26 and enters the spin cell 10 which is at a much lower temperature and pressure than the letdown chamber 24. At such a low pressure and temperature, the spin agent evaporates or flashes from the polymer such that the polymer is immediately formed into plexifilamentary film-fibrils. The plexifilamentary film-fibrils exit the spin orifice 26 at very high velocity and are formed into a flattened web W by impacting a baffle 29. The baffle 29 further redirects the flattened web along a path that is roughly 90 degrees relative to the axis of the spin orifice (generally downwardly in the FIG. 1). The baffle 29, as described in other DuPont patents such as those noted above, rotates at high speed and has a surface contour to cause the web W to oscillate in a back and forth motion in the widthwise direction of the conveyor belt 15.

On the conveyor belt 15, the sheet has the form of a batt of fibers very loosely attached together. The batt is run under a nip roller 16 to consolidate the batt into the sheet product S which is then wound up on roll 17. The sheet product S is then taken to a finishing facility where it may be subjected to an assortment of processes depending on the desired end use for the sheet material. For example, the sheet product S may be fully bonded to make TYVEK® sheet material for envelopes and housewrap. TYVEK® is a registered trademark of DuPont. Fully bonded sheet is formed from the sheet product S by pressing it on heated rolls. The heat is maintained at a predetermined temperature (depending on the desired characteristics of the final sheet product) such that the web bonds together under pressure to form a sheet that has substantial strength and toughness while maintaining its opaque quality.

One of the concerns when running a flash spinning system is maintaining the pressure and temperature of the solution at desired levels as the polymer moves to the spin orifice. As the spin agent evaporates at the spin orifice 26, the spin orifice and its local environment are subject to evaporative cooling. To counteract the loss of heat at the spin orifice, steam is provided to circulate within the spinpack 12. As shown in FIG. 2, the spin block 30 of the conventional spinpack 12 is made of high strength stainless steel and includes steam channels 31 to maintain a desired temperature for the polymer solution and to provide heat to both the spin orifice 26 and the nozzle 33 adjacent the spin orifice 26. The nose of the spin head is made of copper which is more conductive of heat than the steel which comprises the majority of the remainder of the spinpack. This copper nose cone 35 is able to efficiently conduct heat from the steam channels of the spin block 30 to the spin orifice. The copper nose cone 35 and the spin block 30 are together jointly referred to herein as the spin head of the spin pack 12.

DuPont is instituting a new flash spinning system as part of a change from using a chlorofluorocarbon ("CFC") spin agent to using other hydrocarbon-based spin agents. While the considerations involved in selecting a spin agent are complicated and outside the scope of the present invention, it is noted that the spinpacks used in the past with the CFC spin agent were very large and provided flexibility in that the structure was large and accessible. For a variety of reasons, the spinpacks most useful with hydrocarbon-based spin agents are far smaller and the elements of such spinpacks must be smaller so as to find a place on the new spinpacks.

The spinpack historically used with CFC spin agents includes a copper nose cone 35 with internal threads (not shown in FIG. 2) arranged to mate with the external threads on a spin block 30. However, in a smaller spinpack, there is much less copper material in the nose cone available to conduct heat from the spinblock to the spin orifice at a rate sufficient to counteract evaporative cooling of the spin orifice. When the size of the spin block is significantly reduced, the resulting dimension of the nose cone 35 becomes too small to conduct sufficient heat to the spin orifice 26 and nozzle 33. The small dimension is of particular concern at the position indicated by the arrows 36 in FIG. 2.

Accordingly, a new means for connecting the copper nose cone to the spin block is needed that provides for improved heat transfer between the spin block and copper nose cone. This new connecting means must function well even though the thermal expansion coefficient for the copper in the nose cone is significantly different than the thermal expansion coefficient for the steel of the remainder of the spinpack. It must be recognized that the dimensions of the copper and steel parts of the spin head will change at different rates as the temperature of the spin head changes from the temperature at which the spinpack is assembled to the operating temperature. The new connecting means must not become loose when the nose cone expands more than the spin block due to their differing rates of thermal expansion. As spinpack reliability is a very important concern for continuous operation of a flash spinning system, any connection problem that could cause a shutdown of a spinpack cannot be tolerated.

Thus, a spinpack is needed that overcomes the above noted drawbacks and provides a nose cone design that will resist loosening during spin cell operation.

More specifically, a nose cone is needed that may expand but will effectively maintain a tight fit against the spin block supporting structure even when the spin block does not expand to the same extent as the nose cone.

The present invention provides an attachment between a first element and a second element wherein the first element has a different and greater coefficient of thermal expansion than said second element. The attachment arrangement includes outwardly directed screw threads on the first element and inwardly directed screw threads on the second element suited for engaging with outwardly directed screw threads. The second element further includes a shoulder which is positioned circumferentially outwardly from said internal threads of the second element. The first element includes a contact surface arranged to contact the shoulder when the first element is threadedly attached and secured to the second element. The shoulder is positioned even with or longitudinally back from the last of the inter-engaged threads between the first and second elements.

BRIEF DESCRIPTION OF THE DRAWINGS

The invention will be more easily understood by a detailed explanation of the invention including drawings. Accordingly, drawings which are particularly suited for explaining the invention are attached herewith; however, it should be understood that such drawings are for explanation only and are not necessarily drawn to scale. The drawings are briefly described as follows.

DETAILED DESCRIPTION OF THE PREFERRED EMBODIMENT

Figure 1:
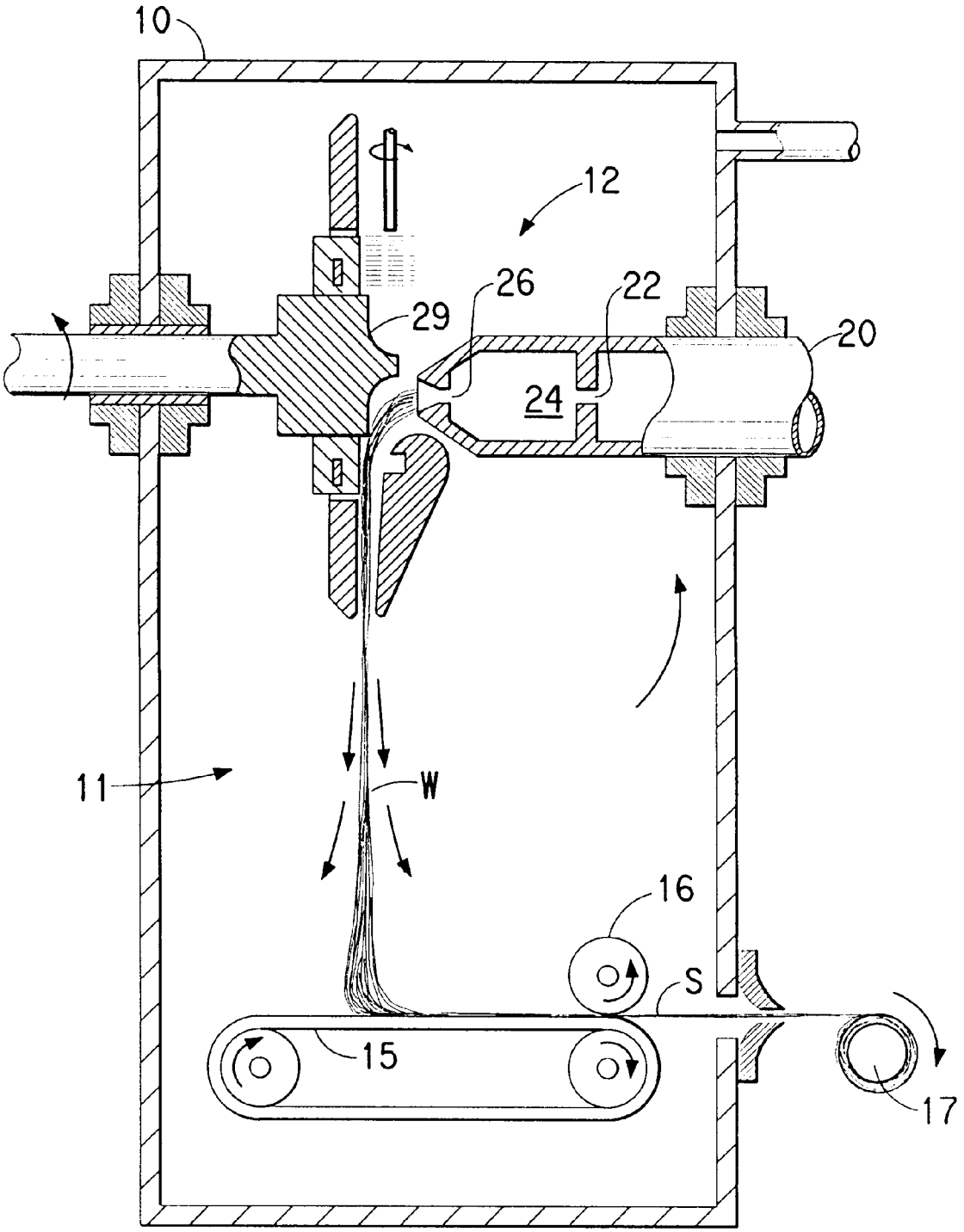
FIG. 1 is a generally schematic cross sectional horizontal elevational view of a single spinpack within a spin cell illustrating the formation of a sheet product.
Figure 2:
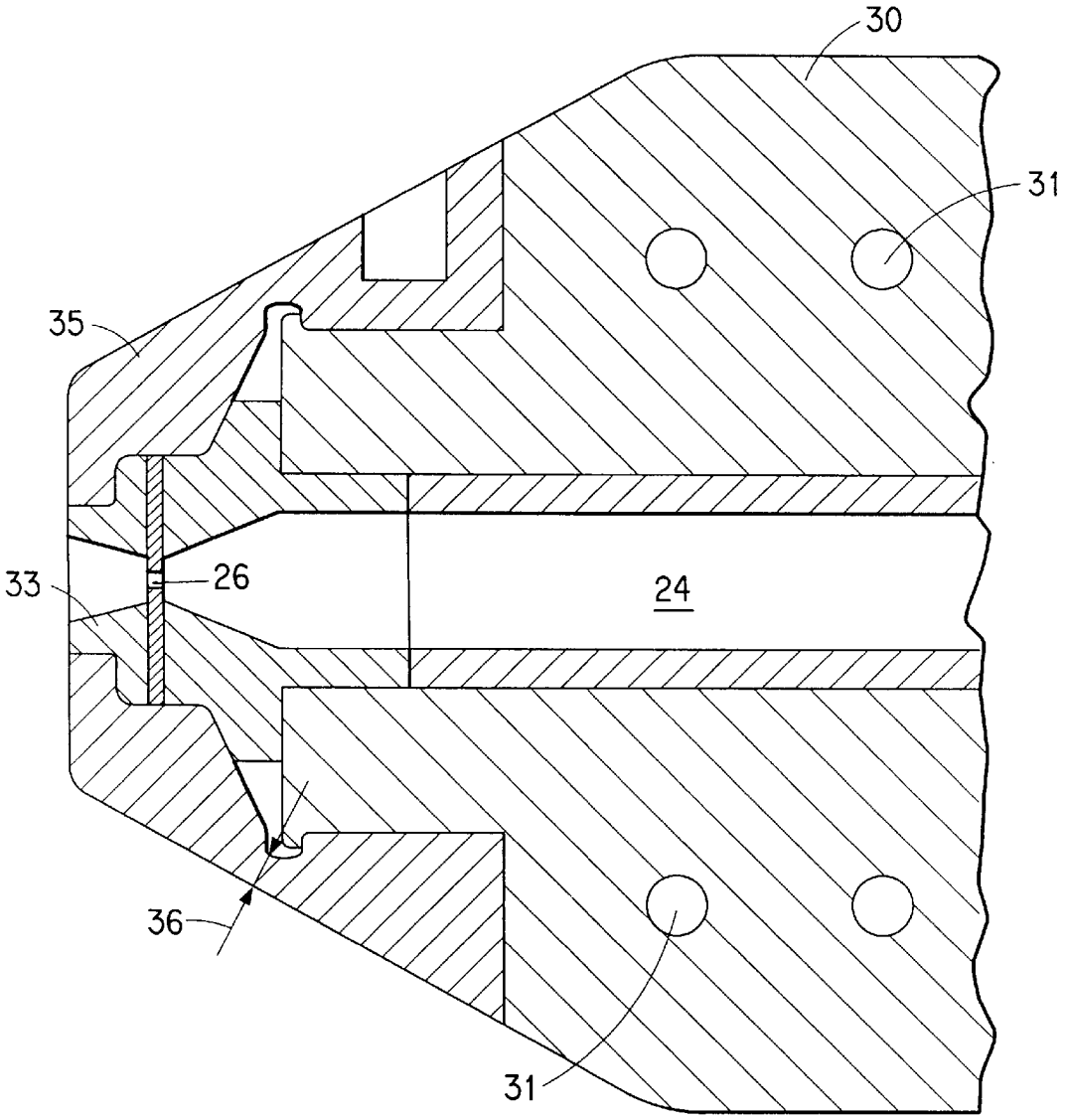
FIG.2 (PRIOR ART)
FIG. 2 is an enlarged fragmentary top view of the spin head portion of a conventional spinpack.
Figure 3:
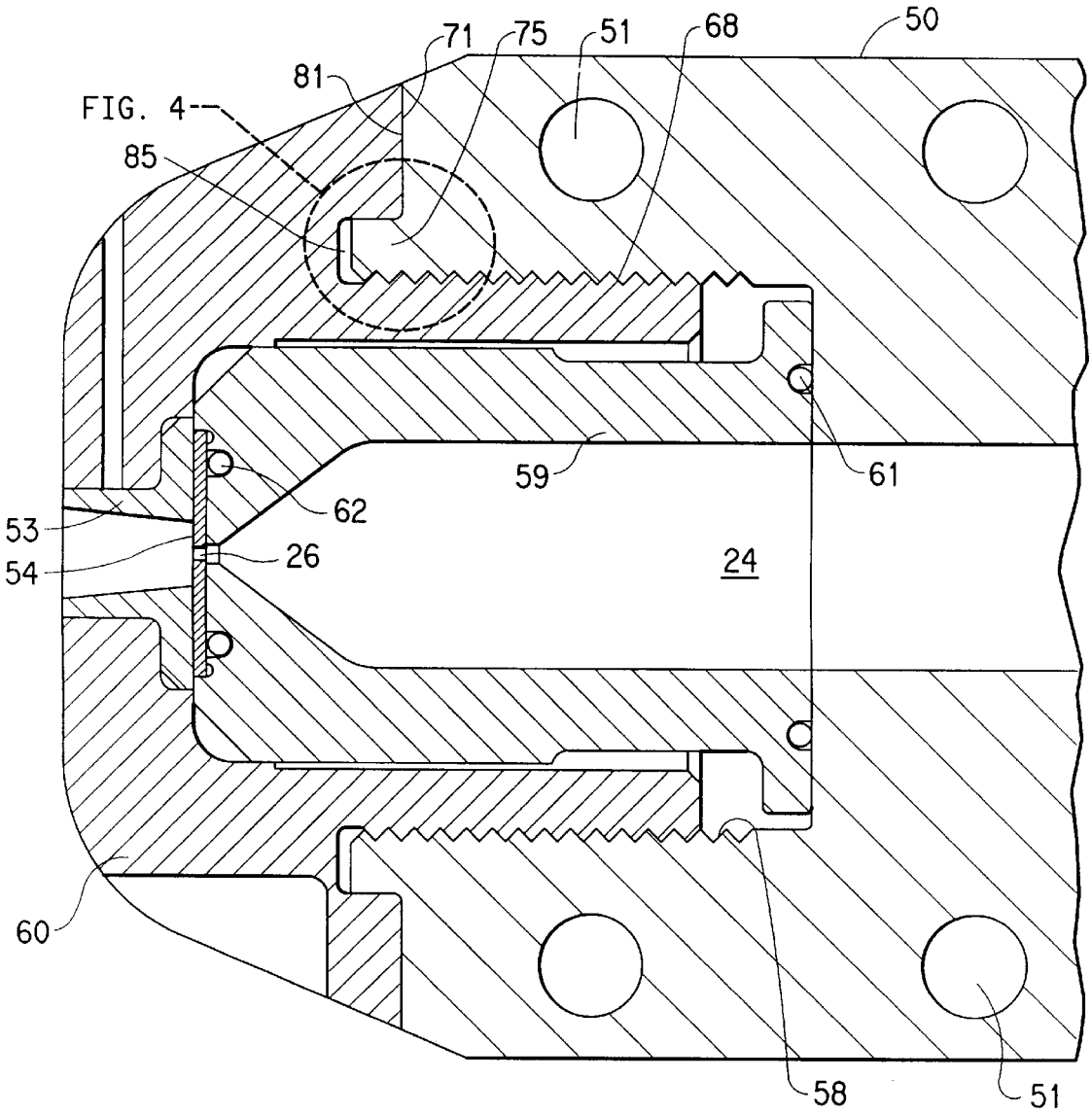
FIG. 3 is an enlarged fragmentary top view of the spin head illustrating the features of the present invention.

Turning now to FIG. 3, the features of the present invention will be more fully explained. In particular, a spin block 50 of a spinpack 12 includes internal screw threads 58 for receiving suitable external screw threads 68 on the nose cone 60. When screw threads are described as internal or external, it is meant to describe the direction the threads face when not engaged. In other words, external screw threads face outwardly from the element upon which the threads are formed. Internal screw threads face toward the axis of the element on which the threads are formed. The nose cone 35 of the conventional spin pack 30 shown in FIG. 2 had internal screw threads, whereas the nose cone 60 of the present invention has external screw threads 68.

Figure 4:
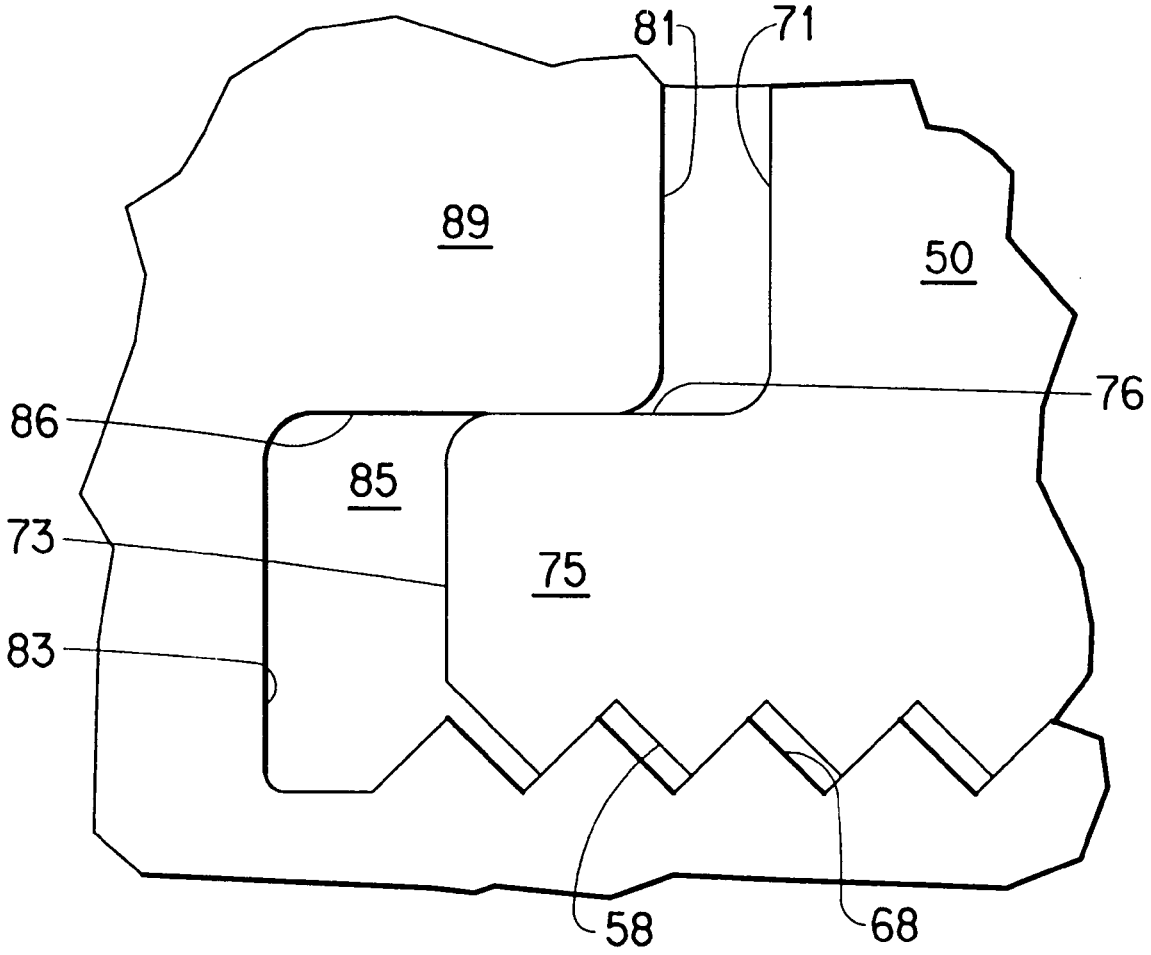
FIG. 4 is a substantially enlarged fragmentary top view of the interface between the nose cone and spin block of the spin head shown in FIG. 3.

Both the nose cone 35 shown in FIG. 2 and the nose cone 60 shown in FIG. 3 are arranged to hold a number of other elements in the spinpack. The nose cone 60 holds a nozzle 53, an orifice plate 54 and an approach 59 to the spin block 50 as generally shown in FIG. 3. O-rings 61 and 62 are arranged to provide seals along the solution path. The spin block 50 further includes a shoulder 71, as best seen in FIG. 4, which is positioned radially outwardly from the threads 58 and circumscribes the same. The nose cone 60 includes a contact surface 81 which also surrounds the threads 68 and is arranged to contact the shoulder 71. In FIG. 4, the nose cone 60 is unscrewed slightly from the spin block 50 so as to more clearly show the features of the invention. In operation, the nose cone 60 is attached to the spin block 50 so that the contact surface 81 of the nose cone 60 is tight against the shoulder 71 of the spin block 50.

The spin block 50 also includes a pilot 75 at the end of the spin block 50. The pilot 75 preferably is of an annular shape that circumscribes the internal threads 58. The pilot 75 has an end surface 73 and a guide surface 76. The nose cone 60 includes a pilot bore 85 suited generally to the shape of the pilot 75 which includes a base 83 and a guide following surface 86. As the nose cone 60 is screwed onto the spin block 50, the screw threads will necessarily have some play. The guide wall 76 and the guide following wall 86 are provided with tight tolerances to provide the precise alignment for the nose cone 60 and the components held by the nose cone 60 that is suitable for a spinpack in a flash spinning system.

It should be noted that the end surface 73 should not fit tightly against the base 83. The longitudinal tight fit is preferred between the contact surface 81 and the shoulder 71. The position of the contact surface 81 (and when fully engaged, the shoulder 71) relative to the screw threads 58 and 68 is important. The contact surface 81 should be positioned longitudinally back from the end of the spin block and more particularly back from the end of the threads 68 nearest to the base 83 (and back from the end of the threads 58 nearest the end surface 73 when threads 58 and 68 are fully engaged). The reason is that the threads 68 on the copper nose cone 60 will be expected to increase in length during the flash spinning operation. If the contact surface were at or beyond the end of the threads, the thermal expansion of the nose cone would cause it to move away from the shoulder 71. However, with the shoulder positioned longitudinally back from the end of the spin block, the contact surface is effectively carried by a skirt 89. The shoulder may be spaced back from the end of the last inter-engaged thread by less than five millimeters. The skirt 89 will also grow from the time the spinpack is assembled until the operating temperature is reached. Thus, the tight fit may actually be engineered to become tighter during operation and looser when the spin block and nose cone have cooled down to ambient temperature such that the spinpacks can be more easily taken apart for cleaning.

It should be seen that the nose cone 60 of the invention does not include a thin portion analogous to the area between arrows 36 in FIG. 2. Thus, the nose cone 60 accomplishes the need for improved conducting of heat from the spin block 50 (provided by the steam channels 51) to the spin orifice plate 54 and nozzle 53.

The foregoing description and drawings were intended to explain and describe the invention so as to contribute to the public base of knowledge. In exchange for this contribution of knowledge and understanding, exclusive rights are sought and should be respected. The scope of such exclusive rights should not be limited or narrowed in any way by the particular details and preferred arrangements that may have been shown. Clearly, the scope of any patent rights granted on this application should be measured and determined by the claims that follow.

I claim:

1. An attachment arrangement for attaching elements of a spin pack, comprising:

a first element and a second element, said first element having a different and greater coefficient of thermal expansion than said second element, said first element having outwardly directed screw threads, said second element having an end and inwardly directed screw threads proximate said end, said inwardly directed screw threads including an end internal thread that is closest to said end of said second element, said inwardly directed screw threads of said second element being suited for inter-engaging with said outwardly directed screw threads of said first element, said second element having a shoulder positioned circumferentially outwardly from said inwardly directed screw threads of said second element and longitudinally back from said end of said second element by a distance greater than the distance that said end internal thread of said second element is spaced back from said end of said second element, said first element having a contact surface arranged to contact the shoulder of said second element when the first element is threadedly attached and secured to the second element and said end internal thread of said second element is engaged by said outwardly directed screw threads of said first element.

2. The attachment according to claim 1 wherein the contact surface of said first element is positioned at the end of a circumferential skirt on said first element.

3. The attachment according to claim 1 further including a pilot with a guide surface on the second element and a guide following surface on the first element.

4. The attachment according to claim 1 wherein additional elements are positioned between the first and second elements and are held in the position by the attachment of the first and second elements together.

5. The attachment according to claim 1 wherein said inwardly directed screw threads of said second element are formed around an axis, and the shoulder and contact surface are generally normal to said axis when the inwardly directed screw threads of said second element and the outwardly directed screw threads of said first element are inter-engaged.

6. The attachment according to claim 1 wherein the shoulder is spaced back from the end of the last inter-engaged thread by less than five millimeters.

7. An attachment arrangement for attaching elements of spinpack in a flash spinning system, comprising:

a nose cone made of a first material and spin block made of a second material, said first material having a different and greater coefficient of thermal expansion than said second material, said nose cone having outwardly directed screw threads, said spin block having an end and inwardly directed screw threads proximate said end, said inwardly directed screw threads including an end internal thread that is closest to said end of said spin block, said inwardly directed screw threads of said spin block being suited for inter-engaging with said outwardly directed screw threads of said nose cone, said spin block having a shoulder positioned circumferentially outwardly from said inwardly directed screw threads of said spin block and longitudinally back from said end of said spin block by a distance greater than the distance that said end internal thread of said spin block is spaced back from said end of said spin block, said nose cone having a contact surface arranged to contact the shoulder of said spin block when the nose cone is threadedly attached and secured to the spin block and said end internal thread of said spin block is engaged by said outwardly directed screw threads of said nose cone.

* * * * *